US005209975A

United States Patent [19]

Miyazaki et al.

[11] Patent Number: 5,209,975

[45] Date of Patent: May 11, 1993

[54] HIGH ELONGATION, HIGH STRENGTH PITCH-TYPE CARBON FIBER

[75] Inventors: Makoto Miyazaki; Kikuji Komine; Takashi Hino, all of Tokyo, Japan

[73] Assignee: Tonen Kabushiki Kaisha, Tokyo, Japan

[21] Appl. No.: 601,486

[22] Filed: Oct. 22, 1990

[30] Foreign Application Priority Data

Oct. 30, 1989 [JP] Japan ..... 1-282387
Oct. 30, 1989 [JP] Japan ..... 1-282389

[51] Int. Cl.[5] ..... D02G 3/00

[52] U.S. Cl. ..... 428/364; 428/367; 423/447.1; 423/447.2

[58] Field of Search ..... 428/367, 364; 423/447.1, 447.2; 264/129.2

[56] References Cited

U.S. PATENT DOCUMENTS 4,822,587 4/1989 Hino et al. ..... 264/29.2 X
4,863,708 9/1989 Seo et al. ..... 264/29.2 X
4,898,723 2/1990 Suto et al. ..... 264/29.2
4,913,889 4/1990 Takai et al. ..... 264/29.2 X
4,983,457 1/1991 Hino et al. ..... 264/29.2 X

FOREIGN PATENT DOCUMENTS 0245035 11/1987 European Pat. Off. .
1385213 2/1975 United Kingdom .
1600216 10/1981 United Kingdom .

*Primary Examiner*—Patrick J. Ryan
*Assistant Examiner*—N. Edwards
*Attorney, Agent, or Firm*—Seidel, Gonda, Lavorgna & Monaco

[57] ABSTRACT

The present invention relates to a high elongation, high strength pitch-type carbon fiber which has an improved handleability. The carbon fiber of this invention has a crystalline structure arranged in such a manner that the angle ($\phi$) is 24°–38°; the stack height ($L_c$) is 19–35 Å; and, the interlayer spacing ($d_{002}$) of the X-ray structural parameter is 3.45–3.50 Å. The atomic ratio of oxygen to carbon on the surface of the fiber measured by X-ray photoelectron spectrometry is 0.1–0.35. The total oxygen content in the fiber is 0.01–0.2 wt. %; and, the elongation is 1.0% or more. The high elongation, high strength pitch-type carbon fiber prepared in accordance with the present invention can be used, for example, as a reinforcing fiber for light-weight structural material employed in the aerospace, automotive and architectural industries.

2 Claims, 2 Drawing Sheets

HIGH ELONGATION, HIGH STRENGTH PITCH-TYPE CARBON FIBER

BACKGROUND OF THE INVENTION

1. Field of the Invention

The present invention relates to a carbon fiber, and, more particularly, to a high elongation, high strength pitch-type carbon fiber which can be easily handled and thereby easily knitted and woven and a manufacturing method therefor. The high elongation, high strength pitch-type carbon fiber according to the present invention can be widely used as a reinforcing fiber for light-weight structural material employed in the space, automobile and architecture industries.

2. Related Art Statement

Hitherto, although PAN-type carbon fibers and rayon-type carbon fibers have been widely manufactured and used, both the PAN-type carbon fiber and the rayon-type carbon fiber have a problem in terms of the cost thereof because they consist of materials which are too expensive and have poor carbonization yield. Accordingly, pitch-type carbon fibers have attracted special interest because they are made of pitch which is inexpensive, and they exhibit excellent tensile strength and tensile elastic modulus.

At present, the pitch-type carbon fiber has been manufactured as follows:

(1) Carbonaceous pitch suitably used to manufacture the carbon fiber is prepared from petroleum pitch or coal pitch so as to be heated and melted before it is spun by a spinning machine so that a pitch fiber bundle is manufactured by collecting and doubling the fibers;

(2) The pitch fiber bundle thus manufactured is heated up to 200° to 350° C. in an atmosphere of an oxidizing gas in an infusible furnace so as to be infusibilized; and (3) Then, the fiber bundle thus infusibilized is heated up to 500° to 2000° C. in an atmosphere of an inert gas so as to carbonize it before it is further heated up to 3000° C. so as to graphitize it.

The pitch-type carbon fiber thus manufactured exhibits an excellent tensile strength of 2.0 GPa (200 kg/mm$^2$) or more and tensile elastic modulus of 600 GPa (60 ton/mm$^2$) or more. However, it has been suffered from unsatisfactory elongation of 0.5% or less in usual, the same being about 1% at the most.

As described above, the elongation of the conventional pitch-type carbon fiber is insufficient to be easily handled. As a result, it cannot be easily knitted and woven, causing a critical problem to be arisen in that an excellent composite material cannot be easily manufactured.

From a study for manufacturing a high elongation pitch-type carbon fiber, the inventors of the invention have found a fact that a pitch-type carbon fiber exhibiting a satisfactory tensile strength and a tensile elastic modulus and as well exhibiting an elongation of 1.0% or more, which enables an excellent knitting and weaving facility to be obtained, can be manufactured from the pitch with maintaining the satisfactory tensile strength and the tensile elastic modulus The above-described pitch-type carbon fiber can be realized by arranging the crystalline structure to be a specific form. That is, in the specific crystalline structure of the present fiber the orientation angle ($\phi$), stack height (Lc) and interlayer spacing ($d_{002}$) of the X-ray structural parameter are 25° to 38°, 19 to 35 Å and 3.45 to 3.50 Å, respectively.

Further, the inventors have found a fact that the adhesive property between the fiber and the matrix resin, which is the most critical factor when a composite material is manufactured from a carbon fiber, considerably depended upon the surface oxygen content of the carbon fiber and the total oxygen content in the whole of the carbon fiber. That is, the adhesive property between the fiber and the matrix resin becomes satisfactory in the case where the atomic ratio (O/C) of oxygen to carbon on the surface of the fiber measured by a X-ray photoelectron spectrometry is 0.1 to 0.35 and the total oxygen content in the whole carbon fiber is 0.01 to 0.2 wt. %. It was found that if the atomic ratio (O/C) of oxygen to carbon on the surface of the fiber is less than 0.1 and the total oxygen content in the carbon fiber is less than 0.01 wt. %, the adhesive property might be excessively deteriorated. Furthermore, it was found that if the atomic ratio (O/C) of oxygen to carbon on the surface of the fiber exceeds 0.35 and the total oxygen content in the carbon fiber exceeds 0.2 wt. %, the tensile strength and the tensile elastic modulus of the carbon fiber deteriorate excessively.

Furthermore, the inventors of the invention found a fact that the above-described novel high elongation and high strength pitch-type carbon fiber can be manufacture by applying a predetermined tention at the time of the carbonization process subjected to the infusibilized fiber and quickly carbonizing the fiber within a range in which the fibers can not be melted and adhered to each other. Furthermore, the adhesive property with the matrix can be improved and the physical property of the fiber can also be improved when the fiber is subjected to oxidation after carbonization.

Thus, the above-described newly findings cause the present invention to be established.

SUMMARY OF THE INVENTION

Accordingly, an object of the present invention is to provide a high elongation, high strength pitch-type carbon fiber and a manufacturing method capable of efficiently manufacturing the above-described pitch-type carbon fiber.

Another object of the present invention is to provide a high elongation, high strength pitch-type carbon fiber which can be easily handled, knitted and woven, which exhibits an excellent adhesive property with the matrix resin and therefore which is suitably used to manufacture a composite material, and to provide a method of manufacturing said fiber.

The above-described objects can be achieved by the high elongation, high strength pitch-type carbon fiber and a manufacturing method therefor according to the present invention.

Briefly, according to an aspect of the invention a high elongation, high strength pitch-type carbon fiber is provided, said fiber comprising: a crystalline structure of the fiber arranged in such a manner that the orientation angle ($\phi$), stack height (Lc) and interlayer spacing ($d_{002}$) of the X-ray structural parameter are 25° to 38°, 19 to 35 Å and 3.45 to 3.50 Å, respectively, wherein the atomic ratio (O/C) of oxygen to carbon on the surface of the fiber measured by X-ray photoelectron spectrometry is 0.1 to 0.35, the total oxygen content in the fiber is 0.01 to 0.2 wt. % and the elongation is 1.0% or more. In usual, the tensile strength of the fiber is 1.5 GPa (150 kg/mm$^2$) or more.

According to another aspect of the invention, a method of manufacturing a high elongation, high strength pitch-type carbon fiber is provided, said method comprising the steps of: performing a infusibilization process for 3 to 30 minutes in an atmosphere of oxygen rich gas the temperature of which is 120° to 350° C. so that the surface layer of a fiber is selectively and strongly oxidized; performing carbonization for 3 to 15 minutes by heating the fiber at the lowest temperature of 400° C. and at the highest temperature of 1300° C. in an atmosphere of an inert gas within a range in which no melting and adhesion take place, and simultaneously by applying a tension of 0.001 to 0.2 g per filament to said fiber; and performing oxidation.

It is preferable that the carbonization is performed in such a manner that the rate at which the temperature is raised is 10° to 90° C./minute from 400° C. to 550° C. and the rate at which the temperature is raised is 100° to 500° C./minute from 550° to 1300° C.

The inventors found a fact that the elongation must be 1.0% or more in order to realize an excellent knitting and weaving facility as a result of a study for manufacturing the pitch-type carbon fiber exhibiting an excellent knitting and weaving facility from the pitch. Furthermore, the inventors found another fact that it is a critical factor to make the crystalline structure to be a specific structure in order to obtain the high elongation pitch-type carbon fiber exhibiting a satisfactorily improved tensile strength and tensile elastic modulus.

Specifically, the inventors found a fact that is is necessary for the crystalline structure of a carbon fiber to be arranged in such a manner that the orientation angle ($\phi$), tack height (Lc) and interlayer spacing ($d_{002}$) of the X-ray structural parameter are 25° to 38°, 19 to 35 Å and 3.45 to 3.50 Å, respectively, so that the high elongation, high strength pitch-type carbon fiber exhibiting an elongation of 1.0% or more and a tensile strength of 1.5 GPa (150 kg/mm$^2$) or more can be obtained. In particular, the inventors found a fact that the orientation angle ($\phi$) is a critical factor acting to determine the elongation of the pitch-type carbon fiber. In addition, another fact was found that the stack height (Lc) and the interlayer spacing ($d_{002}$), each of which is one of factors to determine the crystalline structure of the fiber, must be ranged in a proper scope in order to preferably balance the elongation, the tensile strength and the elastic mudulus.

Namely, if the orientation angle ($\phi$) is smaller than 20°, there cannot be obtained the satisfactory elongation, that is, the elongation of 1.0% or more, which is necessary to realize the excellent knitting and weaving facility. If the orientation angle ($\phi$) exceeds 38°, the tensile elastic modulus excessively deteriorates, resulting in loosing an advantage in the excellent elastic modulus which is the natural characteristic of the carbon fiber. Furthermore, if the stack height (Lc) and the interlayer spacing ($d_{002}$) do not meet the range between 19 to 35 Å and the range between 3.45 to 3.50 Å, respectively, a problem takes place in that the desired tensile strength and tensile elastic modulus cannot be obtained.

As described above, in order to manufacture the high elongation, high strength pitch-type carbon fiber, it is necessary to properly balance the orientation angle ($\phi$), the stack height (Lc) and the interlayer spacing ($d_{002}$) of the X-ray structural parameter in an extremely narrow range.

With the present pitch-type carbon fiber having specific crystalline structure described above, there can be obtained the high elongation and high strength pitch-type carbon fiber having an elongation of 1.0% or more, in general 1.0 to 5.0%, a tensile strength of 150 kg/mm$^2$ or more.

The high elongation, high strength pitch-type carbon fiber according to the present invention displays the atomic ratio (O/C) of oxygen to carbon on the surface of the fiber measured by a X-ray photoelectron spectrometry of 0.1 to 0.35 and the total oxygen content in the whole fiber of 0.01 to 0.2 wt. %. It was therefore found that the carbon fiber according to the present invention is able to be, as it is, employed as the reinforcing fiber with exhibiting an excellent adhesive property with the matrix resin of the composite material so that high tensile strength and high tensile elastic modulus carbon fiber reinforcing composite material is realized.

Furthermore, another fact was found that the carbon fiber according to the present invention is able to act to manufacture a high tensile strength and high tensile elastic modulus carbon fiber and graphite fiber after it was carbonized in increased temperature if necessary.

Then, a method of manufacturing the carbon fiber according to the present invention will be described.

The carbon fiber according to the present invention can be manufactured in such a manner that a spinning nozzle into which an insertion member exhibiting an excellent thermal conductivity is inserted is used for the purpose of preventing the temperature change of the molten pitch in the spinning nozzle, in particular, the drop of the temperature so that a carbonaceous pitch fiber is first manufactured. According to the above-described spinning method, an advantage can be obtained in that the disorder of crystallite in the carbonaceous pitch fiber taken place at the time of the spinning work can be suitably controlled.

The pitch fiber thus obtained is then heated, for 3 to 30 minutes, from the lowest temperature of 120° to 200° C. to highest temperature of 240° to 350° C. at a temperature rise rate of 1° to 20° C./minute in an atmosphere of oxygen rich gas (the oxygen content is 30 to 100%) so that the pitch fiber is infusibilized.

The fiber thus infusibilized is then heated up to 400° to 550° C. at a temperature rise rate of 10° to 90° C./minute in an atmosphere of an inert gas, for example, nitrogen or argon gas. Then, it is heated from 550°60 to 1300° C. at a temperature rise rate of 100° to 500° C./minute so that it is carbonized in a relatively short time, for example, in 3 to 15 minutes. As described above, the carbon fiber according to the present invention can be manufactured by quickly, selectively and strongly oxidizing (however, the oxidizing of the inner portion of the fiber is restricted) the surface of the fiber in an atmosphere of hot and oxygen rich gas at the time of infusibilization before it is quickly carbonized in an atmosphere of an inert gas within a range in which the fibers cannot be adhered to each other. According to the present invention, the angle of the orientation is improved by applying a tension of 0.001 to 0.2 g per filanent so that the fiber is forcibly oriented.

As a result, a high elongation, high strength pitch-type carbon fiber the elongation of which is 1.0% or more, in usual 1.0 to 5.0% and the tensile strength of which is 1.5 PGa (150 kg/mm$^2$) or more can be manufactured.

The high elongation, high strength pitch-type carbon fiber thus manufactured is then subjected to oxidation so that the surface oxygen content of the fiber and the total oxygen content in the whole fiber are adjusted so as to meet the above-described predetermined ranges. The oxidation can be preferably performed in an atmosphere containing oxygen for a short time, for example, by heating the fiber at 700° C. for 30 seconds in an atmosphere of oxygen rich gas the content of which is 60%. As a result of the high temperature and short time oxidation, the adhesive property of the carbon fiber with the matrix resin and the physical property of the carbon fiber are improved.

The carbon fiber is, if necessary, then heated up to 2000° C. in an atmosphere of an inert gas so as to further carbonize it before it is then heated up to 3000° C. so as to graphitize the carbonized fiber. As a result, a high strength, high elastic modulus pitch-type carbon fiber can be obtained which has a tensile strength of 3.0 GPa (300 kg/mm$^2$) or more and a tensile elastic modulus of 600 GPa (60 ton/mm$^2$) or more.

The above and other objects, features and advantages of the present invention will become clear from the following description of the preferred embodiments.

DETAILED DESCRIPTION OF THE PREFERRED EMBODIMENTS

Figure 1:
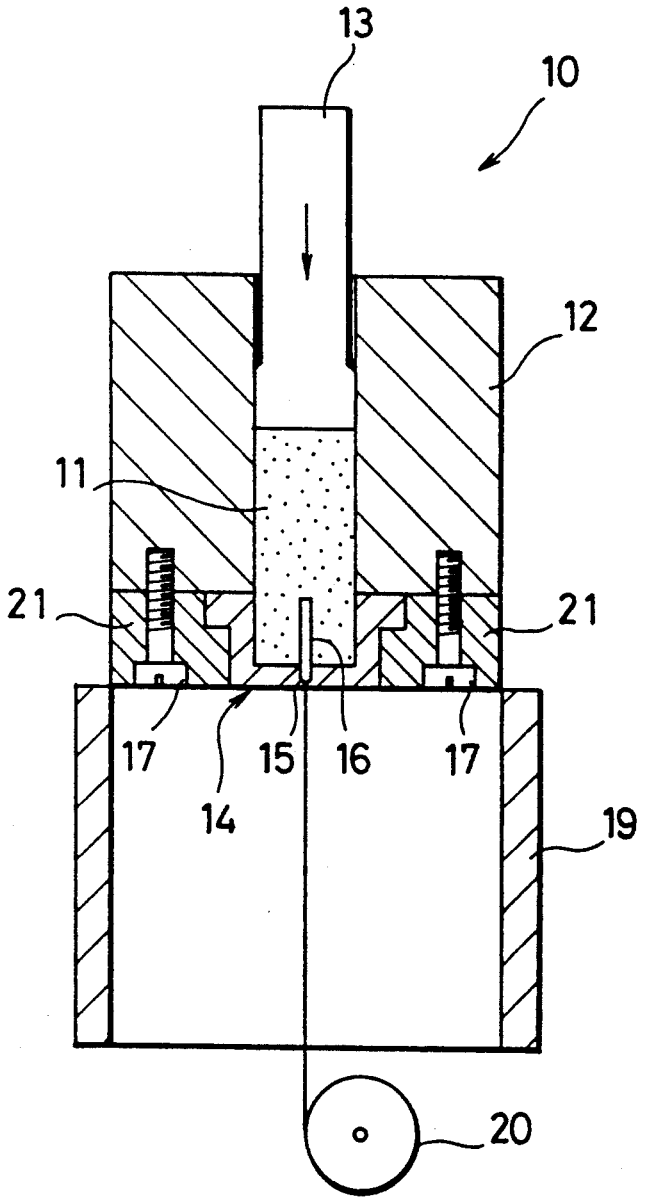
FIG. 1 is cross sectional view which illustrates an example of a spinneret in a spinning apparatus for manufacturing a carbon fiber according to the present invention.

The high elongation, high strength pitch-type carbon fiber and the method of manufacturing the fiber according to the present invention will be more fully understood from the following description of a preferred embodiment.

In this specification, the characteristics of the carbon fiber were measured by the following methods.

X-ray Structural Parameter

The orientation angle ($\phi$), the stack height (Lc) and the interlayer spacing ($d_{002}$) are parameters which can be measured by X-ray diffraction methods and which shows the fine crystalline structure of the carbon fiber.

The orientation angle ($\phi$) shows the selective orientation of the crystallite with respect to the axis of the fiber. The more the angular degree becomes small, the more better the orientation becomes. The stack height (Lc) shows the thickness of the apparent height of the stack of the (002) plane of the carbon fine crystallite. In general, the more the stack height (Lc) becomes large, the more better the crystallinity becomes. The interlayer spacing ($d_{002}$) shows the distance between layers of the (002) plane of the fine crystallite. It is considered that smaller value of the interlayer spacing ($d_{002}$) suggests a higher degree of crystallinity.

The measurement of the orientation angle ($\phi$) can be performed by using a fiber sample holder in such a manner that diffraction angle $2\theta$ (about 26°) is previously obtained at which the strength of the (002) diffraction ring becomes its maximum magnitude by scanning with a counter tube with the fiber bundle made positioned perpendicular to the surface scanned by the counter tube. Then, the fiber sample holder is rotated by 360° with the position of the counter tube maintained so that the distribution of the strength of the (002) diffraction ring is measured. Thus, let the half-width at the point at which the maximum strength becomes halved be the orientation angle ($\phi$).

The stack height (Lc) and the interlayer spacing ($d_{002}$) are measured and analyzed by pulverizing the fiber in a mortar in conformity with *Gakushinho* "Method of Measuring the Lattice Constant of Artificial Graphite and the Size of Crystallite", legistated in the 117th Committee of the Japan Society for the Promotion of Science, from the following formulae:

$$Lc = K\lambda/\beta\cos\theta$$

$$d_{002} = \lambda/2\sin\theta$$

where $K = 1.0$, $\lambda = 1.5418$ Å

$\nu$: obtainable from (002) diffraction angle $2\theta$ $\beta$: half-width of the (002) diffraction line obtained from a correction

Measurement of the Surface Oxygen Content ($O_{1s}/C_{1s}$) By X-ray Photoelectron Spectrometry It is measured by using XSAM-800 manufactured by KRATOS. The fiber to be measured is cut into pieces so as to arrange them on a sample supporting metal holder before the pressure in the sample chamber is maintained at $1\times10^{-8}$ Torr or lower. As the X-ray source, MgKa$\alpha_{1,2}$ is used. The surface oxygen content is obtained from the ratio between the peak area of $O_{1s}$ at kinetic energy of 722 eV and the peak area of $C_{1s}$ at kinetic energy of 970 eV.

The term "surface of the fiber" used in this specification means an extremely thin layer of about 0.01 $\mu$m or less from the surface of the fiber to the central portion thereof.

Then, examples of the present invention will be described.

EXAMPLE 1

Carbonaceous pitch containing an optically anisotropic phase (AP) by about 50% was used as precursor pitch, which was then drawn out through an AP discharge port at a centrifugal force of 10000G in a cylindrical continuous centrifugal separator having a rotor the internal effective capacity of which was 200 ml with the temperature of the rotor maintained at 350° C. The obtained pitch contained the optically anisotropic phase by 98% and the softening point of which was 276° C.

Figure 2:
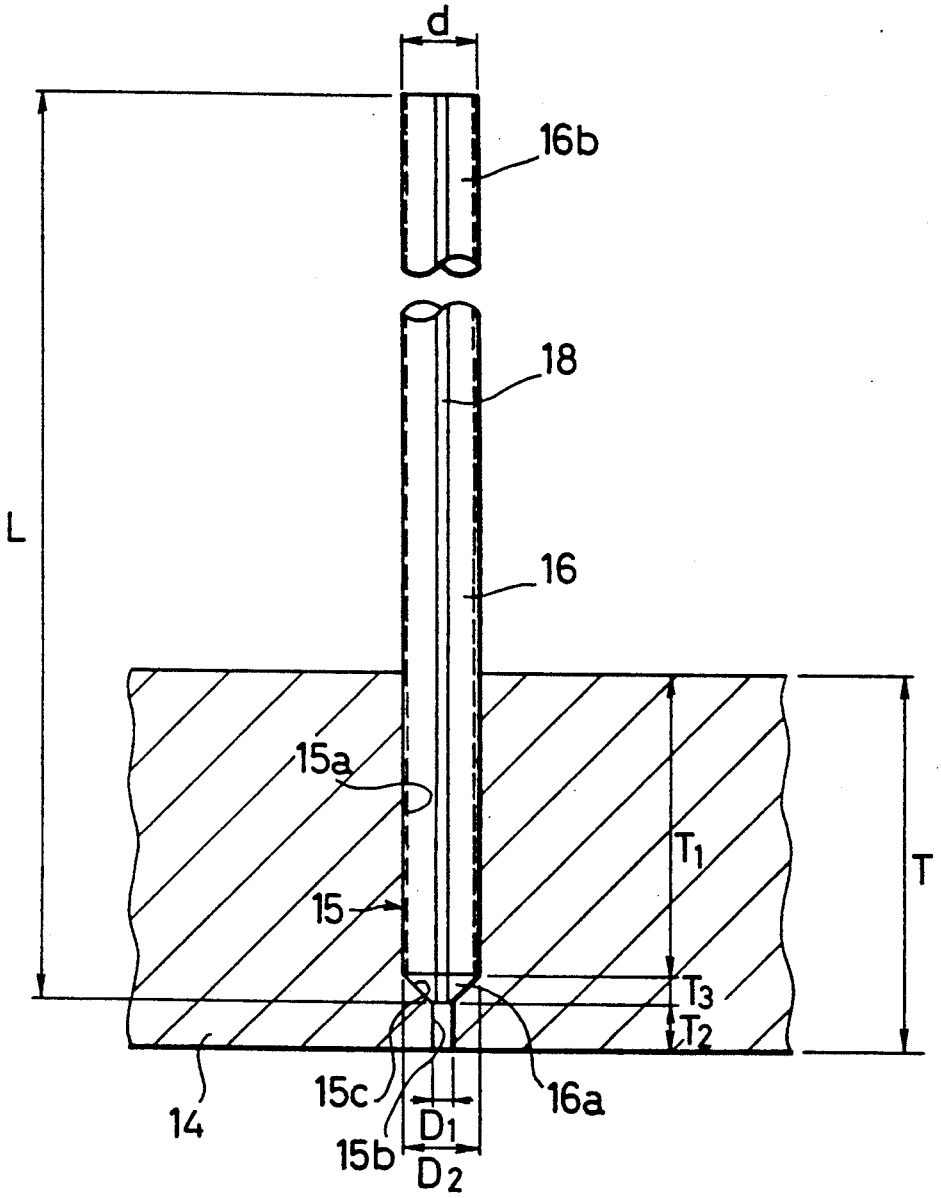
FIG. 2 is a cross sectional view which illustrates an example of an insertion member used in the spinneret shown in FIG. 1.
Figure 3:
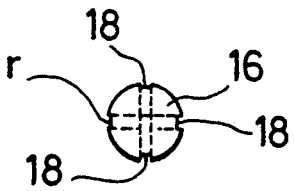
FIG. 3 is a plan view which illustrates an example of an insertion member used in the spinneret shown in FIG. 1.

The thus obtained optically anisotropic pitch was spun by a melt spinning apparatus having a nozzle the diameter of which was 0.3 mm. The spinning apparatus and the spinneret used in the spinning are illustrated in FIGS. 1 to 3.

The spinning apparatus 10 comprised a heating cylinder 12 into which molten pitch 11 was injected from a pitch pipe, a plunger 13 for applying pressure to the pitch injected into the heating cylinder 12 and a spinneret 14 fastened to the bottom of the heating cylinder 12. The spinneret 14 had a spinning nozzle 15 bored therein and was detachably fastened to the lower surface of the heating cylinder 12 by bolts 17 and spinneret retainers 21. The thus spun pitch fiber was wound to a winding bobbing 20 after it had passed through a spinning cylinder 19.

According to this example, the spinning nozzle 15 formed in the spinneret 14 comprised a nozzle introduction portion 15*a* having a relatively large diameter and a nozzle portion 15*b* having a relatively small diameter and formed so as to be connected to the nozzle introduction portion 15*a*. Furthermore, a nozzle transition portion 15*c* in the form of a circular truncated cone was formed between the large-diameter nozzle introduction portion 15*a* and the small-diameter nozzle portion 15*b*. The spinneret 14 was made of stainless steel (SUS304). The thickness (T) of the spinning nozzle 15 was arranged to be 5 mm. Furthermore, the length ($T_1$) of the large-diameter nozzle introduction portion 15*a* and the length ($T_2$) of the small-diameter nozzle portion 15*b* were arranged to be 4 mm and 0.65 mm, respectively. The length ($T_3$) of the transition portion 15*c* of the spinning nozzle 15 was 0.35 mm. The diameter ($D_1$) of the large-diameter nozzle introduction portion 15*a* and the diameter ($D_2$) of the small-diameter nozzle portion 15*b* were arranged to be 1 mm and 0.3 mm, respectively.

Furthermore, an insertion member 16 having a thermal conductivity which was larger than that of the spinneret 14 and made of, according to this example, copper was provided for the large-diameter nozzle introduction portion 15*a* of the spinning nozzle 15. The insertion member 16 was arranged to be in the form of an elongated rod shape having an end portion 16*a* which was proximated to the inlet of the small-diameter nozzle portion 15*b* and another end portion 16*b* which extended outwards from the inlet of the large-diameter nozzle introduction portion 15*a*. The overall length (L) of the insertion member 16 was arranged to be 20 mm and the diameter (d) of the same was arranged to be a diameter with which a gap between the large-diameter nozzle introduction portion 15*a* and the insertion member 16 became 1/100 to 5/100 mm so that the insertion member 16 was able to be smoothly inserted into the large-diameter nozzle introduction portion 15*a* and thereby held by the same.

In order to introduce the molten pitch into the nozzle portion 15*b*, four grooves 18 having a circular-arc cross-section the radius (r) of each of which was 0.15 mm were formed in the surface of the insertion member 16 in the axial direction thereof.

When the molten pitch was spun by the thus-structured spinning apparatus, the temperature drop of the molten pitch, which was taken place at the time when the molten pitch passed the spinning nozzle, was maintained below 3° C.

The pitch fiber thus obtained was heated in an atmosphere of oxygen rich gas containing 60% of oxygen from 180° C., which is the starting temperature, to 310° C. at a temperature rise rate of 13° C./minute so that it was infusibilized in 10 minutes.

After it had been infusibilized, the fiber was heated from 400° C. to 550° C. at a temperature rise rate of 50° C./minute in an atmosphere of nitrogen gas and then the same was further heated from 550° C. to 1100° C. at a temperature rise rate of 250° C./minute so that the fiber was carbonized. In this case, the time in which the temperature of 1100° C. was maintained was zero. The total carbonizing time was 5.2 minutes.

In order to improve the angle of the orientation of crystallite of the fiber, a tension of 0.017 g was applied to each of the filaments at the above-described carbonization process.

The thus carbonized carbon fiber was further maintained at 700° C. and was passed through an atmosphere of oxygen rich gas ($O_2/N_2=60/40$) in which the content of oxygen in nitrogen gas phase was 60% for 30 seconds.

The above-described carbon fiber was subjected to X-ray diffraction measurements, resulting that the orientation angle ($\phi$) was 32° the stack height (Lc) was 19.4 Å and the interlayer spacing ($d_{002}$) was 3.484 Å.

The diameter of filament of the fiber was 9.9 μm, the tensile strength was 2.8 GPa (280 kg/mm$^2$), the tensile elastic modulus was 110 GPa (11 ton/mm$^2$) and the elongation was 2.5%. As is shown from these results, the fiber had high elongation and flexibility.

The fiber thus manufactured was subjected to the X-ray photoelectron spectrometry so as to measure the oxygen content of the surface of the fiber, resulting that the atomic ratio (O/C) of oxygen to carbon on the surface of the fiber was 0.151. The total oxygen content in the whole fiber obtained by elemental analysis was 0.1 wt. %.

The interlayer shearing strength (ILSS) of the thus obtained fiber was measured. As a result, satisfactory strength of 0.132 GPa (13.2 kg/mm$^2$) was obtained.

The carbon fiber thus obtained was heated up to 2500° C. so that a graphite fiber was obtained. As a result, the graphite fiber showed satisfactory physical properties such that the diameter of a filament was 9.8 μm, the tensile strength was 4.1 GPa (410 kg/mm$^2$) and the tensile elastic modulus was 700 GPa (70 ton/mm$^2$).

Comparative Example 1

The infusibilized fiber and the carbon fiber were prepared by using the same method and the same material as those in Example 1. However, the oxidation of the carbon fiber was not conducted unlike Example 1.

As a result of the X-ray diffraction measurements, the orientation angle ($\phi$) was 32°, the stack height (Lc) was 19.5 Å and the interlayer spacing ($d_{002}$) was 3.485 Å.

The diameter of filament of the fiber was 10 μm, the tensile strength was 2.5 GPa (250 kg/mm$^2$), the tensile elastic modulus was 110 GPa (11.0 ton /mm$^2$) and the elongation was 2.3%.

The fiber thus manufactured was subjected to the X-ray photoelectron spectrometry so as to measure the oxygen content of the surface of the fiber, resulting that the atomic ratio (O/C) of oxygen to carbon on the surface of the fiber was 0.03. The total oxygen content in the filament obtained by elemental analysis was 0.01 wt. % or less.

The interlayer shearing strength (ILSS) of the thus obtained fiber was measured, resulting 9.0 kg/mm$^2$.

The carbon fiber thus obtained was heated up to 2500° C. so that a graphite fiber was obtained. As a result, the graphite fiber showed satisfactory physical properties such that the diameter of a filament was 9.8 μm, the tensile strength was 3.5 GPa (350 kg/mm$^2$) and the tensile elastic modulus was 700 GPa (70 ton/mm$^2$).

Comparative Example 2

The infusibilized fiber was prepared by using the same method and the same material as those in Example 1. Similarly to Example 1, the infusibilized fiber was carbonized so that the carbon fiber was manufactured except for the difference in that no tension was applied to the infusibilized fiber. The oxidation of the carbon fiber after the carbonization was not performed.

As a result of the X-ray diffraction measurements of the thus obtained carbon fiber, the orientation angle ($\phi$)

was 41°, the stack height (Lc) was 19.5 Å and the interlayer spacing ($d_{002}$) was 3.497 Å.

The diameter of filament of the fiber was 10 μm, the tensile strength was 0.7 GPa (70 kg/mm²), the tensile elastic modulus was 80 GPa (8.0 ton /mm²) and the elongation was 0.9%.

The carbon fiber thus obtained was heated up to 2500° C. so that a graphite fiber was obtained. As a result, the graphite fiber showed that the filament diameter was 9.8 μm, the tensile strength was 2.8 GPa (280 kg/mm²) and the tensile elastic modulus was 650 GPa (65 ton/mm²).

Comparative Example 3

The infusibilized fiber was prepared by the same method and the same material as those in Example 1.

Similarly to Example 1, the infusibilized fiber was carbonized so that the carbon fiber was manufactured except for the difference in that a tension of 0.33 g per filament was applied to the infusibilized fiber. However, the oxidation of the carbon fiber after the carbonization was not performed.

As a result of the X-ray diffraction measurements of the thus obtained carbon fiber, the orientation angle (ϕ) was 24°, the stack height (Lc) was 19.5 Å and the interlayer spacing ($d_{002}$) was 3.482 Å.

The diameter of filament of the fiber was 10 μm, the tensile strength was 1.3 GPa (130 kg/mm²), the tensile elastic modulus was 140 GPa (14 ton /mm²) and the elongation was 0.9%.

The carbon fiber thus obtained was heated up to 2500° C. so that a graphite fiber was obtained. As a result, the graphite fiber showed that the filament diameter was 9.8 μm, the tensile strength was 2.8 GPa (280 kg/mm²) and the tensile elastic modulus was 750 GPa (75 ton /mm²).

Comparative Example 4

The infusibilized fiber was prepared by using the same method and the same material as those in Example 1.

Similarly to Example 1, the infusibilized fiber was carbonized so that the carbon fiber was manufactured except for the difference in that the infusibilized fiber was heated from 400° C. to 1100° C. at a temperature rise rate of 5° C./minute in 140 minutes. However, the oxidation of the carbon fiber after the carbonization was not performed.

As a result of the X-ray diffraction measurements of the thus obtained carbon fiber, the orientation angle (ϕ) was 41°, the stack height (Lc) was 19.6 Å and the interlayer spacing ($d_{002}$) was 3.495 Å.

The diameter of filament of the fiber was 10 μm, the tensile strength was 0.8 GPa (80 kg/mm²), the tensile elastic modulus was 90 GPa (9.0 ton /mm²) and the elongation was 0.9%.

The carbon fiber thus obtained was heated up to 2500° C. so that a graphite fiber was obtained. As a result, the graphite fiber showed that the diameter of filament was 9.8 μm, the tensile strength was 2.8 GPa (280 kg/mm²) and the tensile elastic modulus was 650 GPa (65 ton /mm²).

Comparative Example 5

The infusibilized fiber was prepared by the same method in which the same material was used.

Similarly to Example 1, the infusibilized fiber was carbonized so that the carbon fiber was manufactured except for the difference in that the infusibilized fiber was heated from 400° C. to 1100° C. at a temperature rise rate of 250° C./minute in about 3 minutes.

In this case, a melting and adhesion took place in part at the time of the carbonization. As a result, no normal filament was obtained.

Comparative Example 6

The same pitch as that in Example 1 was used so as to spin it at spinning temperature of 330° C. by using a spinneret having no insertion member. The thus obtained pitch fiber was heated from 180° C. up to 255° C. at a temperature rise rate of 0.3° C./minute in an atmosphere of air so that it was infusibilized.

The thus obtained infusibilized fiber was heated from 400° C. to 1100° C. at a temperature rise rate of 5° C./minute in 140 minutes in an atmosphere of nitrogen gas without no tension so that it was carbonized. The maintaining time at 1100° C. was zero. The oxidation of the carbon fiber after the carbonization was not performed.

As a result of the X-ray diffraction measurements o of the thus obtained carbon fiber, the orientation angle (ϕ) was 43°, the stack height (Lc) was 19.5 Å and the interlayer spacing ($d_{002}$) was 3.497 Å.

The diameter of filament of the fiber was 10 μm, the tensile strength was 0.6 GPa (60 kg/mm²), the tensile elastic modulus was 75 GPa (7.5 ton /mm²) and the elongation was 0.8%.

The carbon fiber thus obtained was heated up to 2500° C. so that a graphite fiber was obtained. As a result, the graphite fiber showed that the filament diameter was 9.9 μm, the tensile strength was 2.6 GPa (260 kg/mm²) and the tensile elastic modulus was 650 GPa (65 ton /mm²).

Comparative Example 7

The infusibilized fiber and the carbon fiber were prepared by using the same method and the same material as those in Example 1.

The thus carbonized carbon fiber was further subjected to the oxidation process for 3 seconds in an atmosphere of oxygen rich gas ($O_2/N_2=60/40$) in which the content of oxygen was 60% in nitrogen phase and the temperature of which was maintained at 700° C.

The diameter of filament of the fiber was 9.9 μm, the tensile strength was 0.8 GPa, the tensile elastic modulus was 89.0 GPa and the elongation was 0.9%. As is shown from these results, the tensile strength was excessively deteriorated.

The fiber thus manufactured was subjected to the X-ray photoelectron spectrometry so as to measure the oxygen content of the surface of the fiber, resulting that the atomic ratio (O/C) of oxygen to carbon on the surface of the fiber was 0.42. The total oxygen content in the whole fiber obtained by elemental analysis was 0.4 wt. %.

The interlayer shearing strength (ILSS) of the thus obtained fiber was measured, resulting 12.5 kg/mm².

The results of Example 1 and Comparative Example 1 to 7 show that it is necessary for obtaining a carbon fiber according to the present invention having high elongation as well as satisfactory tensile strength and tensile elastic modulus to apply a predetermined tension to the infusibilized fiber at the time of the carbonizing process and further to quickly carbonize the fiber within a range in which the fiber is not melted and adhered. Furthermore, the results show that the oxygen content of the surface of the fiber and the total oxygen content in the whole fiber must be limited to a predetermined range by quickly oxidizing the fiber at high temperature in an atmosphere of oxygen rich gas for a short time. In particular, the physical property of the fiber and the adhesive property of the fiber with the matrix resin can be improved and the interlayer shearing strength can be increased by quickly oxidizing the fiber at high temperature in the atmosphere of oxygen rich gas for a short time.

As will be understood from the foregoing description, the pitch-type carbon fiber having a specific crystalline structure according to the present invention exhibits an excellent tensile strength and tensile elastic modulus as well as an excellent elongation exceeding 1.0% or more. Therefore, the knitting and weaving facility can be improved so that the carbon fiber can be significantly easily handled in the manufacturing process, causing the manufacturing efficiency thereof to be satisfactorily improved. Consequently, the pitch-type carbon fiber according to the present invention can be extremely effectively used as reinforcing fibers for light-weight structural materials of various fields such as space development, automobile production and architecture and so forth. Furthermore, a significantly high strength and high elastic modulus carbon fiber can be obtained by carbonizing the fiber by heating the fiber up to 2000° C. and further heating the same up to 3000° C. so as to graphitize it. Moreover, the fiber according to the present invention exhibits an extremely excellent adhesive property with the matrix resin in the case where it is used as a reinforcing fiber for a composite material. As a result, an effect can be accomplished in that a superior carbon fiber reinforcing composite material can be obtained.

Although the invention has been described in its preferred form with a certain degree of particularly, it is understood that the present disclosure of the preferred form has been changed in the details of construction and the combination and arrangement of parts may be restored to without departing from the spirit and the scope of the invention as hereinafter claimed.

What is claimed is:

1. A high elongation, high strength pitch-type carbon fiber comprising:

a crystalline structure arranged in such a manner that the angle ($\phi$), stack height (Lc) and interlayer spacing ($d_{002}$) of the X-ray structural parameter are 25° to 38°, 19 to 35 Å and 3.45 to 3.50 Å, respectively, wherein the atomic ratio (O/C) of oxygen to carbon on the surface of said fiber measured by X-ray photoelectron spectrometry is 0.1 to 0.35, the total content of oxygen in said fiber is 0.01 to 0.2 wt. % and the elongation is 1.0% or more.

2. A high elongation, high strength pitch-type carbon fiber according to claim 1, wherein its tensile strength is 1.5 GPa or more.

* * * * *